US005846336A

United States Patent [19]

Skrovan

[11] Patent Number: 5,846,336

[45] Date of Patent: Dec. 8, 1998

[54] APPARATUS AND METHOD FOR CONDITIONING A PLANARIZING SUBSTRATE USED IN MECHANICAL AND CHEMICAL-MECHANICAL PLANARIZATION OF SEMICONDUCTOR WAFERS

[75] Inventor: John Skrovan, Boise, Id.

[73] Assignee: Micron Technology, Inc., Boise, Id.

[21] Appl. No.: 855,941

[22] Filed: May 14, 1997

Related U.S. Application Data

[62] Division of Ser. No. 654,134, May 28, 1996, Pat. No. 5,645,682.

[51] Int. Cl.[6] ..... B08B 7/04

[52] U.S. Cl. ..... 134/10; 134/21; 134/32; 134/33; 134/2; 134/6

[58] Field of Search ..... 451/56, 60, 444, 451/446, 447; 15/302, 4; 134/6, 9, 10, 26, 33, 2, 32, 34, 36, 902, 21

[56] References Cited

U.S. PATENT DOCUMENTS 5,167,667 12/1992 Prigge et al. ..... 134/34 X 5,645,682 7/1997 Skrovan ..... 156/636.1

5,692,947 12/1997 Talieh et al. ..... 451/41

*Primary Examiner*—Jill Warden

*Assistant Examiner*—Alexander Markoff

*Attorney, Agent, or Firm*—Seed and Berry LLP

[57] ABSTRACT

An apparatus for chemically conditioning a surface of a planarizing substrate while a semiconductor wafer is planarized on the substrate. The conditioning apparatus has a conditioning solution dispenser that deposits a conditioning solution onto the substrate, and a conditioning solution barrier that removes the conditioning solution from the substrate to prevent the conditioning solution from contacting the wafer or diluting the planarizing solution. The conditioning solution dispenser is positioned over the planarizing substrate down-stream from the wafer with respect to the path along which the substrate travels. The conditioning solution barrier is positioned down-stream from the conditioning solution dispenser and upstream from the wafer to remove the conditioning solution from the surface of the substrate. The conditioning solution barrier accordingly cleans the surface of the substrate so that planarizing solution may be dispensed onto a surface relatively free from other fluids or particles.

20 Claims, 4 Drawing Sheets

APPARATUS AND METHOD FOR CONDITIONING A PLANARIZING SUBSTRATE USED IN MECHANICAL AND CHEMICAL-MECHANICAL PLANARIZATION OF SEMICONDUCTOR WAFERS

CROSS REFERENCE TO RELATED APPLICATION

This application is a divisional application of U.S. patent application Ser. No. 08/654,134, filed May 28, 1996, now U.S. Pat. No. 5,645,682.

TECHNICAL FIELD

The present invention relates to an apparatus and method for conditioning planarizing substrates used in mechanical and planarization of semiconductor wafers.

BACKGROUND OF THE INVENTION

Chemical-mechanical planarization ("CMP") processes remove material from the surface of a wafer in the production of ultra-high density integrated circuits. In a typical CMP process, a wafer is exposed to an abrasive medium under controlled chemical, pressure, velocity and temperature conditions. One abrasive medium used in CMP processes is a slurry solution with small, abrasive particles that abrade the surface of the wafer, and chemicals that etch and/or oxidize the surface of the wafer. Another abrasive medium used in CMP processes is a generally planar planarizing substrate made from a relatively porous matrix material, such as blown polyurethane. To increase the abrasiveness of planarizing substrates, abrasive particles are embedded into the matrix material. Thus, when the wafer moves with respect to the abrasive medium, material is removed from the surface of the wafer mechanically by the abrasive particles in the substrate and/or the slurry, and chemically by the chemicals in the slurry.

In some new CMP processes, a planarizing liquid without abrasive particles is used with an abrasive substrate covered with fixed abrasive particles. The present invention is applicable to any CMP process that removes material from the surface of the wafer.

FIG. 1 schematically illustrates a CMP machine 10 with a platen 20, a wafer carrier 30, a planarizing substrate 40, and a planarizing solution 44 on the planarizing substrate 40. The planarizing substrate 40 may be a conventional polishing pad made from a continuous phase matrix material such as polyurethane, or it may be a substrate covered with fixed abrasive particles. The planarizing solution 44 may be a conventional CMP slurry with abrasive particles, or it may be a planarizing liquid without abrasive particles. An under-pad 25 is typically attached to an upper surface 22 of the platen 20, and the planarizing substrate 40 is positioned on the under-pad 25. In most conventional CMP machines, a drive assembly 26 rotates the platen 20 as indicated by arrow A. In another existing CMP machine, the drive assembly 26 reciprocates the platen back and forth as indicated by arrow B. The motion of the platen 20 is imparted to the substrate 40 through the under-pad 25 because the planarizing substrate 40 frictionally engages the under-pad 25.

The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier, or an actuator assembly 36 may be attached to the wafer carrier 30 to impart axial and rotational motion, as indicated by arrows C and D, respectively.

In the operation of the CMP machine 10, the wafer 12 is positioned face-downward against the planarizing substrate 40 and at least one of the platen 20 or the wafer carrier 30 is moved relative to the other. As the face of the wafer 12 moves across the planarizing surface 42, the planarizing substrate 40 and the planarizing solution 44 remove material from the wafer 12.

One problem with CMP processing is that the throughput may drop, and the uniformity of the polished surface may be inadequate, because the condition of the polishing surface on the substrate deteriorates while polishing a wafer. The planarizing substrate surface deteriorates because waste particles from the wafer, substrate, and slurry accumulate on the planarizing substrate. The waste matter alters the condition of the polishing surface on the planarizing substrate causing the polishing rate to drift over time. The problem is particularly acute when planarizing doped silicon oxide layers because doping softens silicon oxide making it slightly viscous as it is planarized. As a result, accumulations of doped silicon oxide glaze the surface of the planarizing substrate with a glass-like material that substantially reduces the polishing rate over the glazed regions. Thus, it is often necessary to condition the substrate by removing the waste accumulations from its polishing surface.

Planarizing substrates are typically conditioned with an abrasive disk that moves across the planarizing substrate and abrades the waste accumulations from the surface of the substrate. One type of abrasive disk is a diamond-embedded plate mounted on a separate actuator that sweeps the plate across the substrate. Some substrate conditioners remove a thin layer of material from the deteriorated polishing surface in addition to the waste matter to form a new, clean polishing surface. Other substrate conditioners may use a liquid solution in addition to the abrasive disks to dissolve some of the waste matter as the abrasive disks abrade the planarizing substrate.

A more specific problem related to conditioning planarizing substrates is that conventional substrate conditioning devices and processes significantly reduce the throughput of CMP processing. During conventional conditioning processes with abrasive disks, large particles often detach from the abrasive disks and/or the substrate. The detached particles may scratch the wafer if the wafer is not removed from the substrate during conditioning, or if the substrate is not cleaned after conditioning. More specifically, therefore, conventional conditioning processes with abrasive disks reduce the throughput of CMP processing because removing the wafer from the substrate and cleaning the substrate after conditioning requires down-time during which a wafer cannot be planarized.

In light of the problems associated with conventional abrasive conditioning processes, it is desirable to chemically condition the substrate by dissolving an adequate amount of waste matter from the substrate without mechanically abrading the waste matter or the planarizing substrate. Chemical conditioning of planarizing substrates is a new and promising method to increase the throughput of the finished wafers. Yet, as explained below, it is difficult to chemically condition a planarizing substrate in situ and in real-time while a wafer is being planarized in some circumstances.

One problem of chemically conditioning a planarizing substrate in situ and in real-time is that the conditioning solution mixes with the planarizing solution. The conditioning solution accordingly dilutes the concentration of abrasive particles in a conventional slurry, and it may react adversely with the chemicals in the planarizing solution. Another problem with chemically conditioning the planarizing substrate is that the conditioning solution may not be chemically compatible with the wafer. Therefore, it would be desirable to develop an apparatus and a method for chemically conditioning a planarizing substrate while a wafer is being planarized.

SUMMARY OF THE INVENTION

The present invention is an apparatus for chemically conditioning a surface of a planarizing substrate while a semiconductor wafer is planarized on the substrate. The conditioning apparatus has a conditioning solution dispenser that deposits a conditioning solution onto the substrate, and a conditioning solution barrier that removes the conditioning solution from the substrate to prevent the conditioning solution from contacting the wafer or diluting the planarizing solution. The conditioning solution dispenser is positioned over the planarizing substrate down-stream from the wafer with respect to the path along which the substrate travels. The conditioning solution barrier is positioned down-stream from the conditioning solution dispenser, but upstream from the wafer, to remove the conditioning solution from the surface of the substrate before the conditioning solution reaches the wafer. The conditioning solution barrier accordingly cleans the substrate to provide a clean surface on the substrate that is substantially free from fluids or particles.

The apparatus preferably includes a planarizing solution dispenser positioned upstream from the wafer, and a planarizing solution barrier positioned between the wafer and the conditioning solution dispenser. The planarizing solution barrier cleans the surface of the substrate after the wafer, thus allowing the conditioning solution to be dispensed onto a surface relatively free from planarizing solution. The conditioning solution and planarizing solution barriers thus divide the substrate into a planarizing zone and a conditioning zone to substantially prevent the conditioning solution and planarizing solution from mixing with one another on the surface of the substrate.

The present invention also includes an inventive method for chemically conditioning a surface of a planarizing substrate in which a planarizing solution is dispensed onto the surface of the substrate at a first location up-stream from the wafer with respect to a substrate path of travel. A conditioning solution is simultaneously dispensed onto the surface of the substrate at a second location down-stream from the wafer with respect to the substrate path of travel. The conditioning solution dissolves an adequate amount of waste matter to bring the substrate into a desired condition without mechanically abrading the waste matter. The planarizing solution and the conditioning solution are then removed from the substrate prior to the first location with respect to the substrate path of travel to clean the surface of the substrate.

DETAILED DESCRITION OF THE INVENTION

The present invention is an apparatus and a method for in situ and real-time chemical conditioning of a planarizing substrate that maintains the integrity of both the planarizing solution, the conditioning solution, and the wafer. An important aspect of the present invention is that the planarizing solution and conditioning solution are dispensed at separate locations over the planarizing substrate. By dispensing the planarizing and conditioning solutions at separate locations, the planarizing substrate is divided into a planarizing zone that is coated by the planarizing solution, and a conditioning zone that is coated by either the conditioning solution alone, or a mixture of the conditioning solution and the planarizing solution. Another important aspect of the present invention is that substantially all of the liquid solutions are removed from the substrate before the location at which the planarizing solution is dispensed onto the substrate. The planarizing solution is accordingly dispensed onto a surface that is substantially free from fluids and other particulate matter. Therefore, the present invention substantially prevents the conditioning solution from mixing with the planarizing solution in the planarizing zone to provide for in situ, real-time chemical conditioning of the planarizing substrate. FIGS. 2–9, in which like reference numbers refer to like parts throughout the various figures, illustrate apparatuses and methods for chemically conditioning a planarizing substrate in accordance with the invention.

Figure 1:
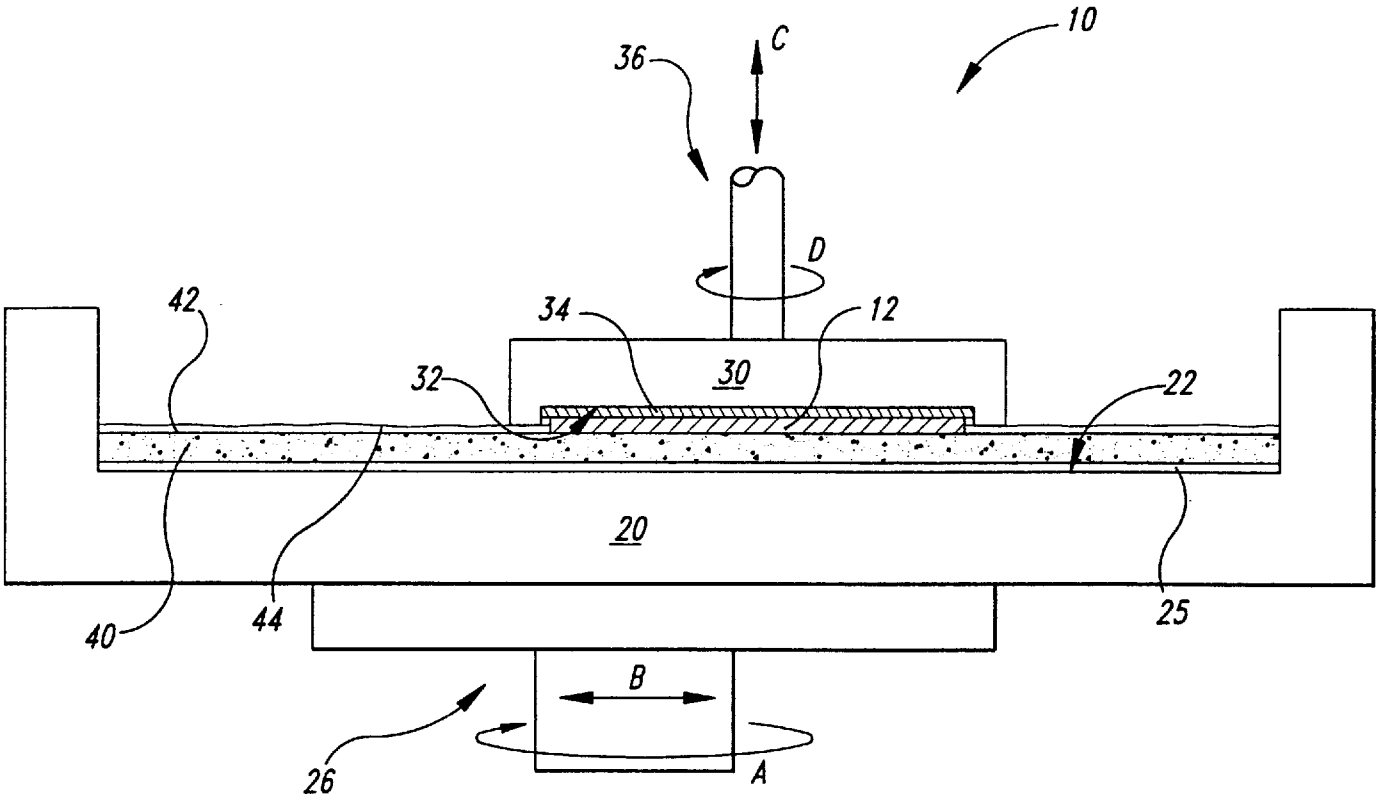
Fig. 1 (Prior Art)
FIG. 1 is a schematic cross-sectional view of a planarizing machine in accordance with the prior art.
Figure 2:
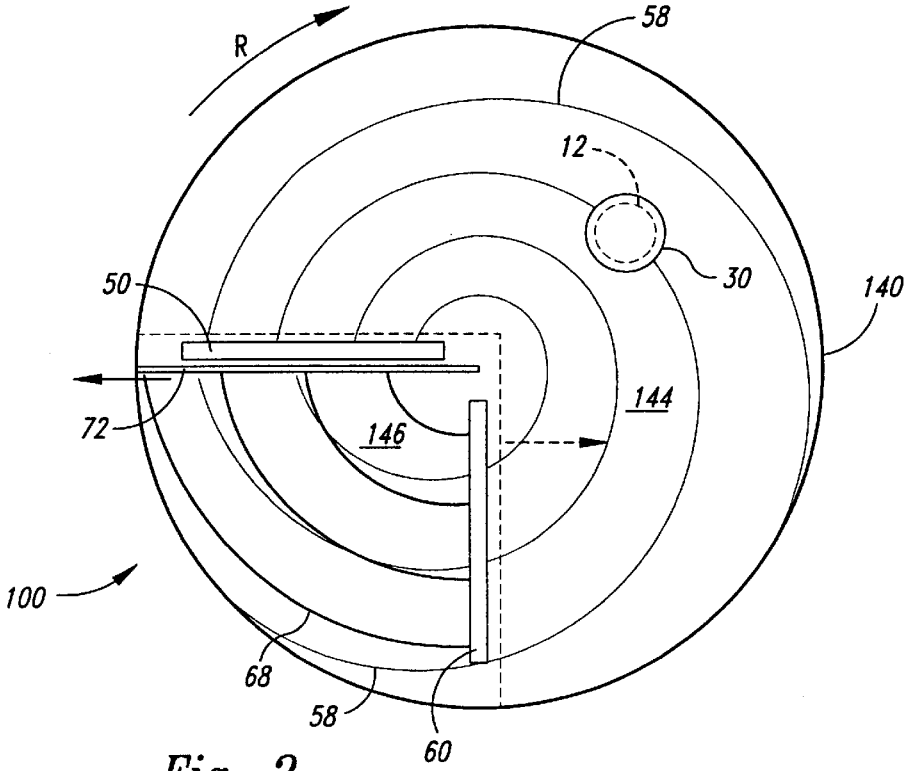
FIG. 2 is a schematic plan view of an apparatus for chemically conditioning a surface of a planarizing substrate in accordance with the invention.

FIG. 2 illustrates a chemical conditioning apparatus 100 for chemically conditioning a planarizing substrate 140, such as a conventional polishing pad or a fixed abrasive substrate, while a wafer 12 is planarized on the substrate 140. As discussed above with respect to FIG. 1, the substrate 140 rotates in a circular path of travel (shown by arrow R), and the wafer carrier 30 presses the wafer 12 against the substrate 140 to planarize the wafer 12.

The chemical conditioner 100 has a planarizing solution dispenser 50, a conditioning solution dispenser 60, and a conditioning solution barrier 72. The planarizing solution dispenser 50 is positioned up-stream from the wafer 12 as viewed with respect to the substrate path of travel. As the substrate 140 moves along the substrate path of travel, the planarizing solution dispenser 50 deposits a planarizing solution 58 onto the surface of the substrate 140. The planarizing solution 58 is represented by thin lines, but it will be appreciated that the planarizing solution is a fluid that covers the surface of the substrate 140 in the areas between the lines shown in FIG. 2. The conditioning solution dispenser 60 is positioned down-stream from the wafer 12 as viewed with respect to the substrate path of travel. As the substrate 140 moves beneath the conditioning solution dispenser 60, the conditioning solution dispenser 60 deposits a conditioning solution 68 onto the surface of the substrate 140. As with the planarizing solution 58, the conditioning solution 68 covers the substrate 140 in the areas between the lines 68 shown in FIG. 2. The conditioning solution barrier 72 is positioned between the planarizing solution dispenser 50 and the conditioning solution dispenser 60, and it operatively engages the surface of the substrate 140 to remove fluid from the surface of the substrate 140 up-stream from the planarizing solution dispenser 50.

In this embodiment of the invention, the conditioning solution 68 mixes with residual planarizing solution 58 that remains on the substrate 140 down-stream from the conditioning solution dispenser 60. The mixture of planarizing solution 58 and conditioning solution 68 is carried by the substrate 140 to the conditioning solution barrier 72, at which point the barrier 72 removes the mixture from the substrate 140. The chemical conditioner 100 preferably dispenses the planarizing solution 58 and the conditioning solution 68 at separate locations over the substrate 140 while the wafer 12 is planarized. The separate locations of the planarizing and conditioning solution dispensers 50 and 60 define a planarizing zone 144 and a conditioning zone 146 over the substrate 140. Since the conditioning solution barrier 72 removes the residual planarizing solution 58 and conditioning solution 68 from the surface of the substrate 140, the planarizing zone 144 is substantially free from residual planarizing solution 58 and conditioning solution 68.

The conditioning solution 68 dissolves accumulations of waste matter (not shown) from the surface of the substrate 140 to bring the substrate to a desired condition without mechanically abrading the wafer 12. Suitable compounds from which the conditioning solution 68 may be made include, but are not limited to, an ammonium hydroxide, an organic substituted ammonium hydroxide, or an alkali hydroxide. More particularly, tetramethyl ammonium hydroxide is a suitable organic substitute ammonium hydroxide, and potassium hydroxide is a suitable alkali hydroxide. To appropriately condition the substrate 140, the distance between the conditioning solution dispenser 60 and the conditioning solution barrier 72 is set to dissolve an adequate amount of waste matter to bring the substrate 140 into a desired planarizing condition. The requisite size of the conditioning zone 146 is a function of the type of material being planarized, the aggressiveness of the conditioning solution 68, and the velocity of the substrate 140. It will be appreciated that the size of the conditioning zone 146 will vary from one application to another.

One advantage of the chemical conditioner 100 is that the substrate may be conditioned with a broad range of chemical conditioning solutions while the wafer is being planarized. By removing the conditioning solution 68 before the planarizing solution dispenser 50, the conditioning solution 68 does not contact the wafer 12 or dilute the planarizing solution 58 in the planarizing zone 144. The substrate 140, therefore, may be conditioned while the wafer 12 is being planarized without adversely affecting the performance of the planarization process.

Figure 3:
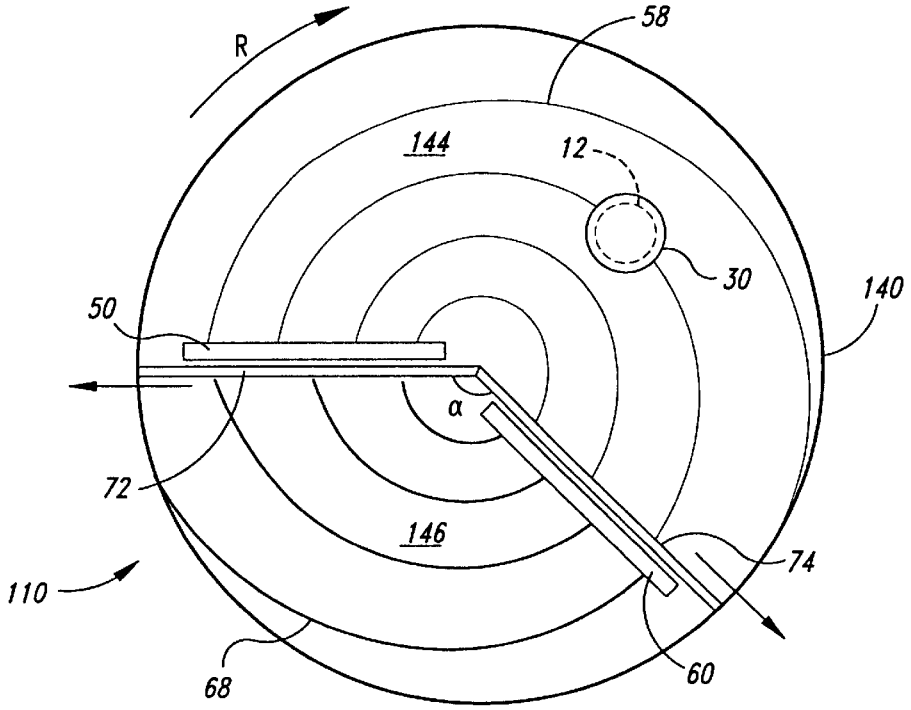
FIG. 3 is a schematic plan view of another apparatus for chemically conditioning a surface of a planarizing substrate in accordance with the invention.

FIG. 3 illustrates another chemical conditioning apparatus 110 that conditions the substrate 140 while a wafer 12 is planarized. As discussed above with respect to the chemical conditioning apparatus 100 of FIG. 2, the conditioning apparatus 110 has a planarizing solution dispenser 50 positioned up-stream from the wafer 12 to deposit the planarizing solution 58 in a planarizing zone 144; a conditioning solution dispenser 60 positioned down-stream from the wafer 12 to deposit the conditioning solution 68 in a conditioning zone 146; and a conditioning solution barrier 72 positioned between the planarizing and conditioning solution dispensers 50 and 60. The chemical conditioning apparatus 110 of FIG. 3 also has a planarizing solution barrier 74 positioned up-stream from the conditioning solution dispenser 60 and down-stream from the wafer 12. The planarizing solution barrier 74 removes the planarizing solution 58 down-stream from the wafer 12 and before the conditioning solution dispenser 60. As a result, the conditioning solution 68 does not mix with the planarizing solution 58.

The conditioning solution and planarizing solution barriers 72 and 74 are preferably pivotally connected to one another and separated by an angle $\alpha$. Because the conditioning zone 146 is approximately equal to the area between the conditioning solution and the planarizing solution barriers 72 and 74, the angle $\alpha$ is varied to control the extent that the substrate 140 is conditioned. For example, if more conditioning is required, the angle $\alpha$ is increased to increase the area on the substrate 140 covered by the conditioning solution 68.

One advantage of the chemical conditioner 110 illustrated in FIG. 3 is that the integrity of both the planarizing solution 58 and the conditioning solution 68 are maintained throughout the planarizing zone 144 and the conditioning zone 146, respectively. By substantially preventing the planarizing solution 58 and the conditioning solution 68 from mixing with one another, the planarizing solution 58 and conditioning solution 68 may generally be selected without regard to the adverse impact on the CMP performance characteristics if the solutions were allowed to mix together. Additionally, because the surface of the planarizing zone 144 is substantially free of conditioning solution 68, the conditioning solution 68 may generally be selected without regard to the adverse impact that the conditioning solution 68 may have on the wafer 12. Therefore, the chemical conditioner 110 provides greater flexibility in chemically conditioning a planarizing substrate while a wafer is being planarized.

Figure 4:
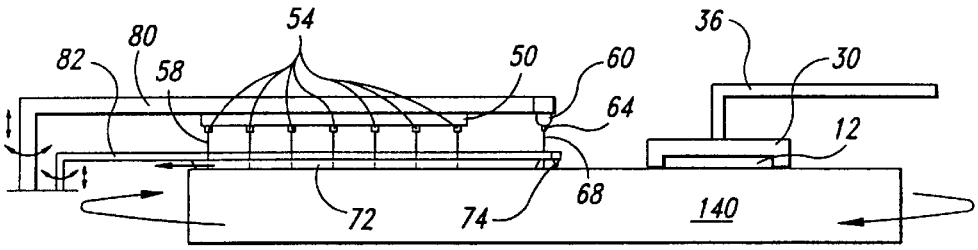
FIG. 4 is a schematic side view of the apparatus of FIG. 3.

FIG. 4 illustrates an embodiment of the chemical conditioner 110 in which the planarizing solution dispenser 50 and the conditioning solution dispenser 60 are mounted to a movable arm 80. The planarizing solution dispenser 50 generally has a plurality of nozzles 54 or an elongated slot (not shown) along its bottom side facing the substrate 140 through which the planarizing solution 58 is deposited onto the substrate 140. Similarly, the conditioning solution dispenser 60 has a plurality of nozzles 64 or an elongated slot (not shown) along its bottom side facing the planarizing substrate 40 through which the conditioning solution 68 is deposited onto the substrate 140. The arm 80 is adapted to rotate and move axially normal to the surface of the substrate 140 to position the planarizing solution dispenser 50 and the conditioning solution dispenser 60 at desired locations with respect to the travel of the substrate 140 and the wafer 12.

Similarly, the conditioning solution and planarizing solution barriers 72 and 74 are attached to a movable arm 82. The arm 82 is adapted to rotate and move axially normal to the surface of the substrate 140 to position the barriers 72 and 74 at desired locations with respect to the planarizing and conditioning solution dispensers 50 and 60, respectively. The arms on CMP machines manufactured by IPEC/Westech of San Jose, Calif. may be readily adapted to carry the solution dispensers and barriers of the invention.

The conditioning solution and planarizing solution barriers 72 and 74 are virtually any type of device that can remove a fluid from the surface of the planarizing substrate 140. FIGS. 5–9 illustrate several embodiments of barriers 72 or 74. For purposes of illustration, only the conditioning solution barrier 72 will be described with the understanding that the planarizing barrier 74 is generally identical.

Figure 5:
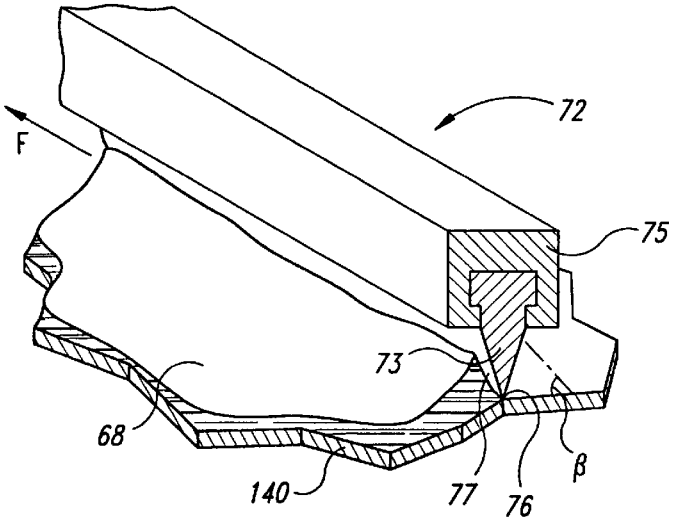
FIG. 5 is a partial isometric view of a barrier used in an apparatus in accordance with the invention.

FIG. 5 illustrates one embodiment of the conditioning solution barrier 72 that has a wiper blade 73 mounted to a blade holder 75. The wiper blade 73 has a tip 76 that engages the surface of the substrate 140, and an elongated front face 77 facing the conditioning solution 68 on the surface of the substrate 140. As the substrate 140 passes under the wiper blade 73, the conditioning solution 68 engages the front face 77 of the wiper blade 73 and flows towards the edge of the substrate 140 (shown by arrow F). The wiper blade 73 is preferably made from a flexible material, such as rubber, but it may also be made from a substantially rigid material that engages the substrate at an acute angle β. A substantially rigid blade is preferably used when the planarizing substrate 40 is made from a soft, partially compressible material that deforms under the force of the blade 73. In another embodiment (not shown) similar to the wiper blade of FIG. 5, an elongated brush may be mounted to the blade holder 75 instead of the blade 73.

Figure 6:
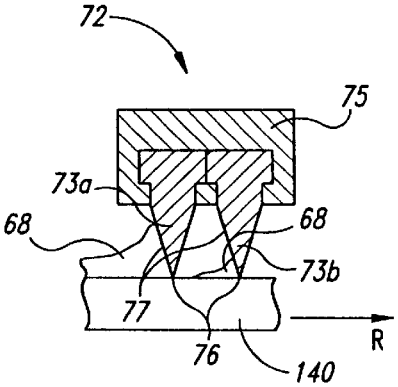
FIG. 6 is a schematic cross-sectional view of another barrier used in an apparatus in accordance with the invention.

FIG. 6 illustrates another embodiment of the conditioning solution barrier 72 in which a plurality of wiper blades 73(*a*) and 73(*b*) are mounted to the blade holder 75. The blades 73(*a*) and 73(*b*) each have a tip 76 and an elongated front face 77. In operation, the tips 76 of the blades 73(*a*) and 73(*b*) contact the surface of the substrate 140 to wipe the conditioning solution 68 from the surface of the substrate 140. As the substrate 140 moves under the blades 73(*a*) and 73(*b*), the majority of the conditioning solution 68 is removed by the forward blade 73(*a*), and then a residual portion of the condition solution 68 that passes underneath the forward blade 73(*a*) is removed by the rearward blade 73(*b*).

Figure 7:
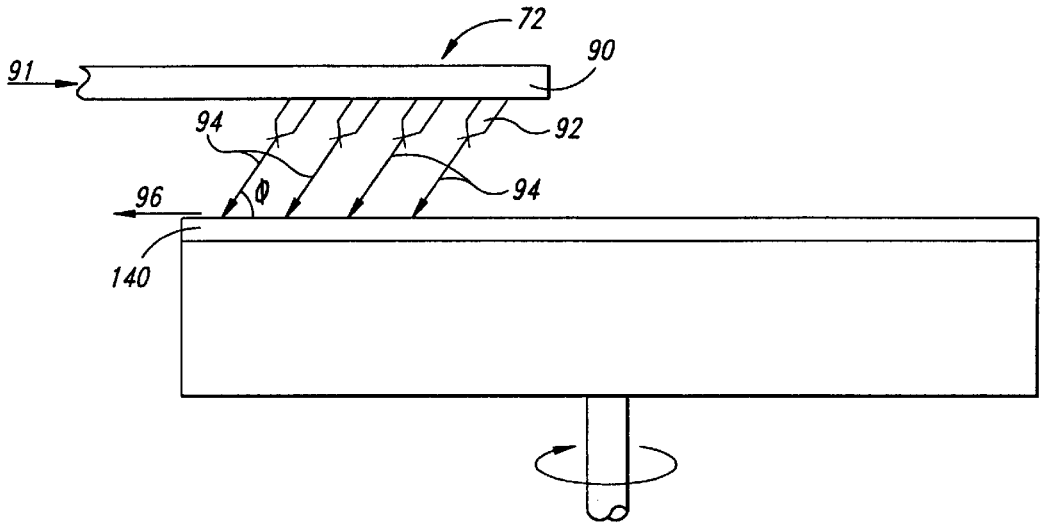
FIG. 7 is a schematic side view of another barrier used in an apparatus in accordance with the invention.

FIG. 7 illustrates still another embodiment of the conditioning solution barrier 72 in which a fluid 91 is divided into a plurality of high-velocity fluid streams 94 directed at the surface of the substrate 140. The conditioning solution barrier 72 has a fluid conduit 90 positioned over the surface of the substrate 140, and a plurality of nozzles 92 are connected to the conduit 90 to direct fluid streams 94 at an angle ϕ with respect to the surface of the substrate 140. The high-velocity fluid streams 94 impinge the surface of the substrate 140 and create a transverse fluid flow 96 across the substrate 140 to remove particles and residual fluids from the substrate 140. The fluid 91 may be a liquid or a gas, and in a preferred embodiment, the fluid 91 is either deionized water or a chemical compatible with the planarizing solution 58.

Figure 8A:
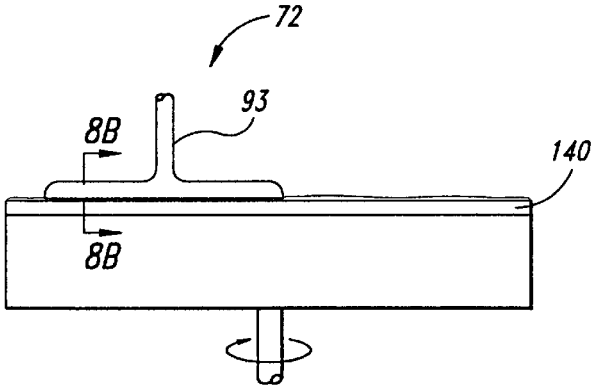
FIG. 8A is a schematic front view of another barrier used in an apparatus in accordance with the invention.
Figure 8B:
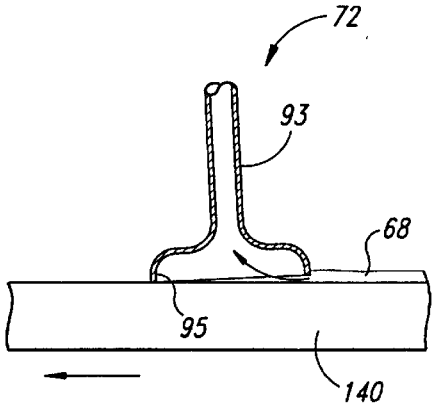
FIG. 8B is a schematic cross-sectional view of the barrier of FIG. 8A.

FIGS. 8A and 8B illustrate another embodiment of the conditioning solution barrier 72 in which a vacuum head 93 with an elongated opening 95 is positioned substantially transversely to the substrate path of travel. The vacuum head 93 creates a suction that draws the conditioning solution 68 through the elongated opening 95 and into the vacuum head 93. In operation, the elongated opening 95 extends over the area of the substrate 140 covered by the conditioning solution 68.

Figure 9:
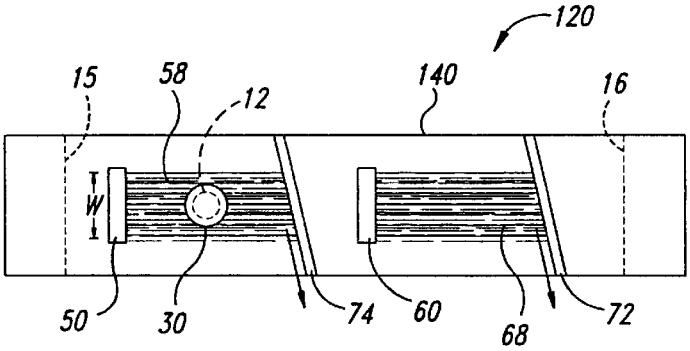
FIG. 9 is a schematic plan view of another apparatus for chemically conditioning a surface of a substrate in accordance with the invention.

FIG. 9 illustrates another chemical conditioning apparatus 120 for conditioning a linear translating planarizing substrate 140. The substrate 140 is a continuous belt-like substrate that travels around rollers 15 and 16, one of which is a drive roller. In this embodiment, the planarizing solution dispenser 50 dispenses the planarizing solution 58 up-stream from the wafer 12, and the planarizing solution barrier 74 is positioned across the substrate 140 down-stream from the wafer 12. The planarizing solution 58 engages the planarizing solution barrier 74 and slides along the barrier 74 to the edge of the substrate 140. The conditioning solution dispenser 60 is positioned down-stream from the planarizing solution barrier 74, and the conditioning solution barrier 72 is positioned across the substrate 140 down-stream from the conditioning solution dispenser 60. The conditioning solution 68 accordingly engages the conditioning solution barrier 72 and slides along the barrier 72 to the edge of the substrate 140. The width of the planarizing solution and the conditioning solution dispensers 50 and 60 may be less than the full width of the substrate 140, and it is preferably approximately equal to the distance W that the wafer 12 moves transversely across the surface of the substrate 140. The advantages of the chemical conditioner 120 are substantially the same as those of the chemical conditioner 110.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A method for conditioning a surface of a planarizing substrate in situ and in real-time during planarization of a wafer on the substrate, comprising:

removing waste matter from the surface of the planarizing substrate with a chemical conditioning solution in a conditioning region along a substrate path of travel by moving the substrate along the substrate path of travel, dispensing the conditioning solution onto the surface of the substrate at a location down-stream from the wafer with respect to the substrate path of travel, and permitting the conditioning solution to remain on the substrate and remove waste matter from the substrate for conditioning the planarizing substrate through chemical action without prior mechanical abrasion of the planarizing substrate; and impeding the chemical conditioning solution from entering a planarizing region with respect to the substrate where the wafer is planarized to inhibit the chemical conditioning solution from contacting the wafer during planarization of the wafer.

2. The method of claim 1 wherein impeding the conditioning solution from entering the planarizing region comprises wiping the surface of the substrate along an axis transverse to the substrate path of travel.

3. The method of claim 1 wherein impeding the conditioning solution from entering the planarizing region comprises spraying the surface of the substrate with a fluid stream directed along an axis transverse to the substrate path of travel.

4. The method of claim 1 wherein impeding the conditioning solution from entering the planarizing region comprises vacuuming the surface of the substrate along an axis transverse to the substrate path of travel.

5. The method of claim 1 wherein impeding the conditioning solution from entering the planarizing region comprises brushing the surface of the substrate along an axis transverse to the substrate path of travel.

6. A method for conditioning a surface of a planarizing substrate in situ and in real-time during planarization of a wafer on the substrate comprising:

dispensing a planarizing solution within a planarizing region along a path of travel of the substrate where the wafer is planarized and a conditioning solution within a conditioning region along the substrate path of travel where the wafer is not planarized, the conditioning solution dissolving waste material accumulated on the substrate, wherein dispensing conditioning solution onto the substrate comprises permitting the conditioning solution to remain on the substrate and remove waste matter from the substrate for conditioning the planarizing substrate through chemical action without prior mechanical abrasion of the planarizing substrate; and removing the conditioning solution and dissolved waste material from the substrate prior to the planarizing region with respect to the substrate path of travel to clean the surface of the substrate of conditioning solution and inhibit the conditioning solution from contacting the wafer during planarization.

7. The method of claim 6 wherein removing the conditioning solution from the substrate comprises wiping the surface of the substrate along an axis transverse to the substrate path of travel.

8. The method of claim 6 wherein removing the conditioning solution from the substrate comprises spraying the surface of the substrate with a fluid stream directed along an axis transverse to the substrate path of travel.

9. The method of claim 6 wherein removing the conditioning solution from the substrate comprises brushing the surface of the substrate along an axis transverse to the substrate path of travel.

10. A method for conditioning a surface of a planarizing substrate in situ and in real-time during planarization of a wafer on the substrate, comprising:

dispensing a planarizing solution within a planarizing region along a path of travel of the substrate where the wafer is planarized and a conditioning solution within a conditioning region along the substrate path of travel where the wafer is not planarized, the conditioning solution dissolving waste material accumulated on the substrate; and removing the conditioning solution and dissolved waste material from the substrate prior to the planarizing region with respect to the substrate path of travel to clean the surface of the substrate of conditioning solution and inhibit the conditioning solution from contacting the wafer during planarization by vacuuming the surface of the substrate along an axis transverse to the substrate path of travel.

11. A method for planarizing a wafer, comprising:

moving a planarizing substrate along a substrate path of travel;

pressing a wafer against a surface of the planarizing substrate in a planarizing region with respect to the substrate path of travel to remove material from the wafer;

removing waste matter from the surface of the planarizing substrate with a chemical conditioning solution in a conditioning region with respect to the substrate by dispensing the conditioning solution onto the surface of the planarizing substrate at a location down-stream from the wafer with respect to the substrate path of travel and permitting the conditioning solution to remain on the substrate and remove waste matter from the substrate for conditioning the planarizing substrate through chemical action without prior mechanical abrasion of the planarizing substrate; and impeding the chemical conditioning solution from entering the planarizing region to inhibit the chemical conditioning solution from contacting the wafer.

12. The method of claim 11 wherein impeding the conditioning solution from entering the planarizing region comprises wiping the surface of the substrate along an axis transverse to the substrate path of travel.

13. The method of claim 11 wherein impeding the conditioning solution from entering the planarizing region comprises spraying the surface of the substrate with a fluid stream directed along an axis transverse to the substrate path of travel.

14. The method of claim 11 wherein impeding the conditioning solution from entering the planarizing region comprises brushing the surface of the substrate along an axis transverse to the substrate path of travel.

15. A method for planarizing a wafer, comprising:

moving a planarizing substrate along a substrate path of travel;

pressing a wafer against a surface of the planarizing substrate in a planarizing region with respect to the substrate path of travel to remove material from the wafer;

removing waste matter from the surface of the planarizing substrate with a chemical conditioning solution in a conditioning region with respect to the substrate; and impeding the chemical conditioning solution from entering the planarizing region to inhibit the chemical conditioning solution from contacting the wafer by vacuuming the surface of the substrate along an axis transverse to the substrate path of travel.

16. A method for planarizing a wafer, comprising:

moving a planarizing substrate along a substrate path of travel;

pressing a wafer against a surface of the planarizing substrate in a planarizing region with respect to the substrate path of travel to remove material from the wafer;

dispensing a planarizing solution within the planarizing region to coat the surface of the substrate under the wafer with planarizing solution;

depositing a conditioning solution within a conditioning region with respect to the substrate path of travel where the wafer is not planarized, the conditioning solution dissolving waste material accumulated on the substrate by permitting the conditioning solution to remain on the substrate and remove waste matter from the substrate for conditioning the planarizing substrate through chemical action without prior mechanical abrasion of the planarizing substrate; and removing the conditioning solution and dissolved waste material from the substrate prior to the planarizing region to clean the surface of the substrate of conditioning solution and inhibit the conditioning solution from contacting the wafer.

17. The method of claim 16 wherein removing the conditioning solution from the substrate comprises wiping the surface of the substrate along an axis transverse to the substrate path of travel.

18. The method of claim 16 wherein removing the conditioning solution from the substrate comprises spraying the surface of the substrate with a fluid stream directed along an axis transverse to the substrate path of travel.

19. The method of claim 16 wherein removing the conditioning solution from the substrate comprises brushing the surface of the substrate along an axis transverse to the substrate path of travel.

20. A method for planarizing a wafer, comprising:

moving a planarizing substrate along a substrate path of travel;

pressing a wafer against a surface of the planarizing substrate in a planarizing region with respect to the substrate path of travel to remove material from the wafer;

dispensing a planarizing solution within the planarizing region to coat the surface of the substrate under the wafer with planarizing solution;

depositing a conditioning solution within a conditioning region with respect to the substrate path of travel where the wafer is not planarized, the conditioning solution dissolving waste material accumulated on the substrate; and removing the conditioning solution and dissolved waste material from the substrate prior to the planarizing region to clean the surface of the substrate of conditioning solution and inhibit the conditioning solution from contacting the wafer by vacuuming the surface of the substrate along an axis transverse to the substrate path of travel.

* * * * *

UNITED STATES PATENT AND TRADEMARK OFFICE

CERTIFICATE OF CORRECTION

PATENT NO. : 5,846,336
DATED : December 8, 1998
INVENTOR(S) : John Skrovan

It is certified that error appears in the above-identified patent and that said Letters Patent is hereby corrected as shown below:

| | Reads | Should Read |
|---|---|---|
| Column 1, line 17 | "mechanical and planarization" | - - chemical-mechanical planarization - - |
| Column 10, line 47 | "removing" | - - should start a new paragraph - - |

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*